US006763583B1

(12) United States Patent
Bryan

(10) Patent No.: US 6,763,583 B1
(45) Date of Patent: Jul. 20, 2004

(54) TOOL FOR WORKING ON LIVE ELECTRICAL WIRES

(76) Inventor: Clyde Wesley Bryan, 10802 Pepper La., Houston, TX (US) 77079

( * ) Notice: Subject to any disclaimer, the term of this patent is extended or adjusted under 35 U.S.C. 154(b) by 152 days.

(21) Appl. No.: 09/666,258

(22) Filed: Sep. 22, 2000

(51) Int. Cl.[7] ..... H01R 43/04

(52) U.S. Cl. ..... 29/863; 29/751; 29/74; 29/755; 72/409.12

(58) Field of Search ..... 29/750, 564.4, 29/566.4, 861, 862, 863, 865, 866, 867, 33 M, 33 F, 741, 755, 751; 81/9.4, 9.41, 9.43, 9.44; 72/409.12

(56) References Cited

U.S. PATENT DOCUMENTS

| | | | | |
|---|---|---|---|---|
| 3,733,627 A | | 5/1973 | Epstein | 7/5.4 |
| 4,206,663 A | | 6/1980 | Pace | 81/311 |
| 4,513,503 A | | 4/1985 | Tremblay | 30/289 |
| 4,722,138 A | * | 2/1988 | Stack | 30/90.1 |
| 4,951,529 A | * | 8/1990 | Laurencot | 81/9.43 |
| 5,277,050 A | | 1/1994 | DeRoss et al. | 72/403 |
| 5,500,998 A | * | 3/1996 | Schmode et al. | 29/566.4 |
| 5,507,207 A | * | 4/1996 | Benoit et al. | 30/90.1 |
| 5,611,138 A | * | 3/1997 | Krampe | 140/121 |
| 5,711,182 A | | 1/1998 | Yang | 72/409.14 |

* cited by examiner

*Primary Examiner*—Carl J. Arbes
*Assistant Examiner*—Thiem Phan
(74) *Attorney, Agent, or Firm*—Russell J. Egan

(57) ABSTRACT

A tool for cutting a live electrical wire and applying a connector thereto in a safe and convenient manner has a housing with a pistol grip and actuating means on a first end and wire preparing and connector application means at the opposite second end. At least the housing is made of electrical insulating material. The wire preparation portion comprises two parallel adjacent sections each having a wire gripping portion, an anvil and opposing cutter. When actuated, the cutter of one section completely severs the live electrical wire and the cutter of the other section, the sections being slightly spaced apart at this time, severs only the insulation of the live electrical wire. Continued movement of the actuation means causes the two sections to spread apart to remove the cut section of insulation from the electrical conductor and allow access of a connector applicator to the exposed end of the electrical conductor. A connector is fed from a magazine into alignment with the exposed end of the electrical conductor and releasing of the actuating means drives the connector onto the exposed portion of the electrical conductor thereby enclosing it and rendering it safe.

13 Claims, 2 Drawing Sheets

TOOL FOR WORKING ON LIVE ELECTRICAL WIRES

BACKGROUND OF THE INVENTION

1. The Field of the Invention

The present invention is related to a tool for working on live electrical wires and, in particular, to a tool which can cut, strip, and apply a connector to a live electrical wire without endangering the electrician.

2. The Prior Art

There are many instances when it is necessary for an electrician to work on live electrical wires. For example, when retrofitting ballasts in fluorescent lighting it may be inconvenient and even hazardous to cut off the circuit while work is being done.

The subject tool allows an electrician to cut a live electrical wire, strip the insulation from the severed end of the wire, and secure a protective connector on the exposed wire without ever endangering the electrician by exposing him to the live electrical conductor during any portion of the process.

It is well known in the prior art have an insulated tool which can be used to sever a live electrical wire while protecting the electrician. Some of these tools are fabricated from non-conductive materials with only the cutting blades being made of metal. Others are metal tools having electrical insulating sleeves on the hand grip portions thereof. However, none of these tools is capable of preparing the severed end of the live electrical wire to receive an electrical connector and then to apply an electrical connector to the live electrical wire. This has previously required the use of separate tools for preparing the electrical wire and applying a connector to the prepared end of the electrical wire. The live electrical conductor would be dangerously exposed between the stripping and connector applying steps, the time period while the electrician is changing tools and is operating in close proximity to the exposed live conductor. Also, if the connector is not easily received on the exposed conductor by the prior art tools, there would be a dangerous temptation for the electrician to manually place the connector thereby exposing himself to the live conductor and possible injury.

SUMMARY OF THE INVENTION

The present invention is a tool for cutting a live electrical wire and applying a connector thereto in a safe and convenient manner. The subject tool has a housing with a pistol grip and actuating means on a first end and wire preparing and connector application means at the opposite second end. The housing, as well as most of the components, is preferably made of electrical insulating material. The wire preparation portion comprises two parallel adjacent sections each having a wire gripping portion, an anvil and opposing cutter. When actuated, the cutter of one section completely severs the live electrical wire and the cutter of the other section, the sections being slightly spaced apart at this time, severs only the insulation of the live electrical wire. Continued movement of the actuation means causes the two sections to spread apart to remove the cut section of insulation from the electrical conductor and allow access of a connector applicator to the exposed end of the electrical conductor. A connector is fed from a magazine into alignment with the exposed end of the electrical conductor and releasing of the actuating means drives the connector onto the exposed portion of the electrical conductor thereby enclosing it and rendering it safe.

BRIEF DESCRIPTION OF THE DRAWINGS

The present invention will now be described, by way of example, with reference to the accompanying drawings, in which.

DETAILED DESCRIPTION OF THE PRESENT EMBODIMENT

Figure 1:
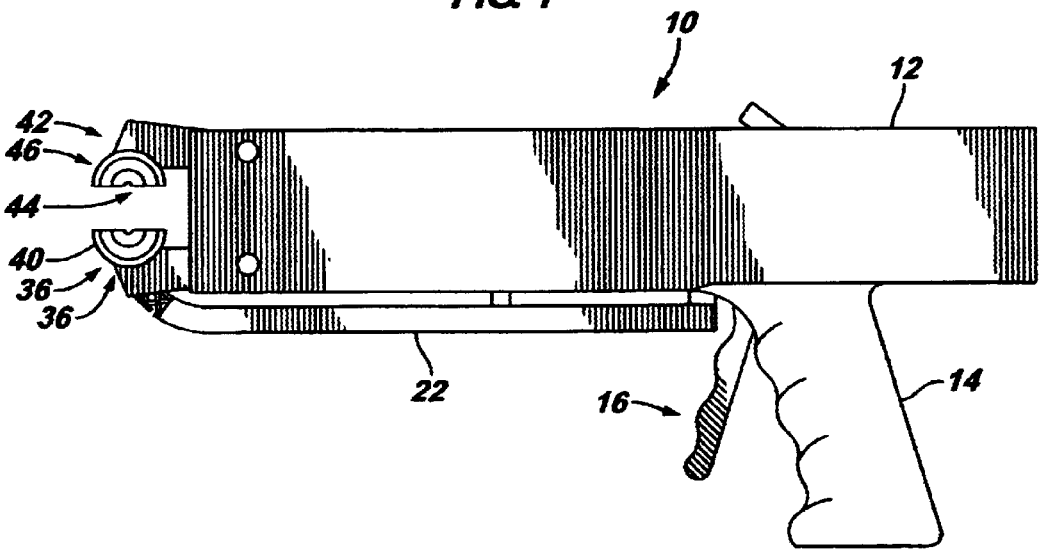
FIG. 1 is a side elevation of the present invention.
Figure 2:
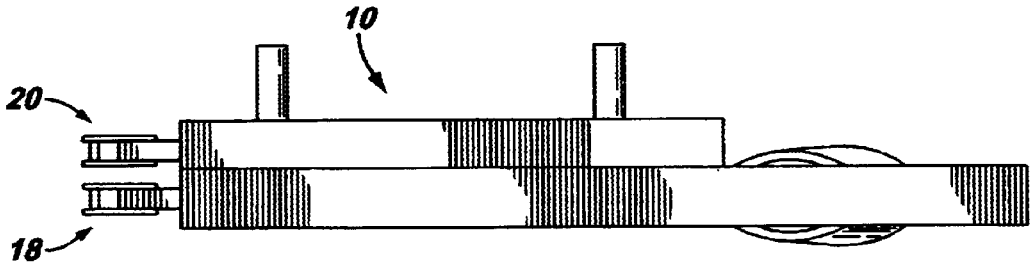
FIG. 2 is a top plan view of the present invention.

The present invention provides a tool for cutting, stripping, and applying a connector to the conductor of a live electrical wire in a safe and convenient manner.

The subject tool 10 has a housing 12 with a pistol grip 14 and actuating means 16 on a first end and wire holder and insulation cutting means 18, wire cutter and stripping means 20, and connector feed and application means 22 at the opposite second end. The housing 12, as well as most of the components, are preferably made of any known electrical insulating material. The wire holder and insulation cutting means 18 and the wire stripping and cutter means 20 are slightly spaced apart so that the live electrical wire 2 is completely cut and a short section of the insulation 4 is substantially simultaneously cut for subsequent removal, which will expose a short section of the live electrical conductor 6.

Figure 5:
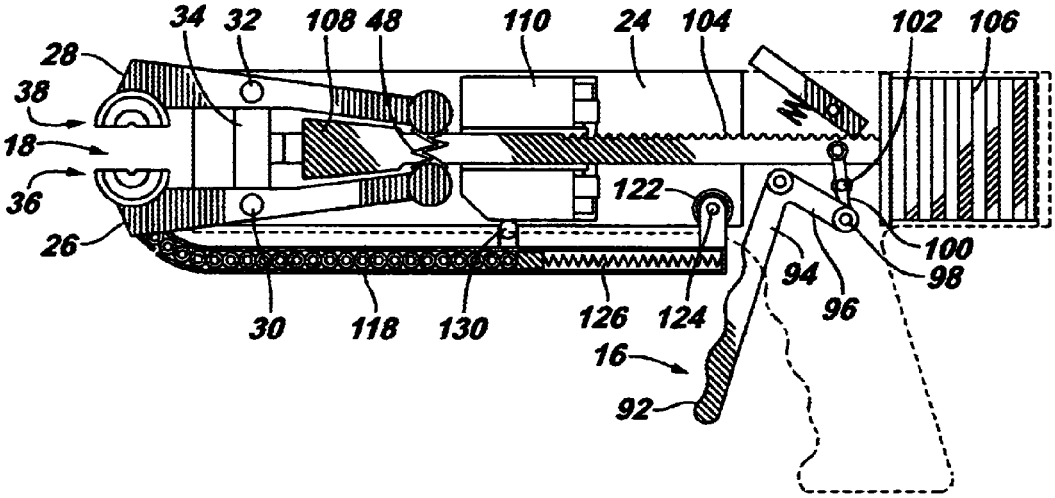
FIG. 5 is a side elevation of the present invention, partially in section taken along line 5—5 in FIG. 3, and showing the wire holder and insulation cutter assembly.

The wire holder and insulation cutting means 18 has a mounting plate 24 with anvil arm 26 and cutter arm 28 mounted toward one end thereof by pivot pins 30, 32, respectively, and link 34. Anvil means 36 is mounted on one end of anvil arm 26 and includes a wire gripping portion 38 and an anvil portion 40 slightly spaced therefrom. Cutter means 42 is mounted on the end of cutter arm 28 and includes a wire gripping portion 44 and cutter blade 46 slightly spaced therefrom. The cutter blade 46 is adapted for cutting only the insulation 4 of the wire 2 without damaging the electrical conductor 6 itself. This can be accomplished by having a single blade curved to fit around the electrical conductor (as shown) or as a plurality of individual stiff wire members (not shown) which will conform to the size of the electrical conductor being prepared and only pierce the insulation thereon. The opposite ends of arms 26,28 are attached to opposite ends of spring 48 biasing the arms to the open position, shown in FIG. 5.

Figure 6:
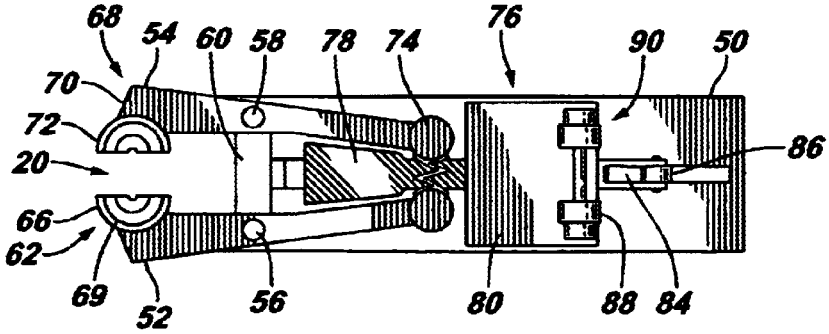
FIG. 6 is a side elevation of the present invention, partially in section taken along line 6—6 in FIG. 3, and showing the wire stripper and cutter assembly as well as the connector feed and application assembly.

The wire stripper and cutter means 20 has a mounting plate 50 with anvil arm 52 and cutter arm 54 mounted toward one end thereof by pivot pins 56, 58, respectively, and link 60. Anvil means 62 is mounted on one end of anvil arm 52 and includes a wire gripping portion 64 and an anvil portion 66. Cutter means 68 is mounted on the end of cutter arm 54 and includes a wire gripping portion 70 and cutter blade 72 slightly spaced therefrom. The cutter blade 72 is preferably a straight blade for cleanly cutting the wire 2. The opposite ends of arms 52,54 are attached to opposite ends of spring 74 biasing the arms to the open position, shown in FIG. 6. Also, mounted on the plate 50 is a first cam assembly 76 having an actuator cam 78 and a cam follower 80. The actuator cam 78 includes a camming portion 82, a guide slot 84, and follower roller 86. The cam follower 80 is secured to the actuator cam 78 and has cam followers 88, 90 thereon.

The actuator means 16 has a trigger 92 mounted in housing 12 by fixed pivot pin 94. One end of first link 96 is connected to the trigger 92 and the opposite end of first link 98 is attached to one end of second link 100. Second link 100 is pivotally mounted, intermediate its ends, on fixed pivot pin 102 in the housing 12 and the other end of the second link 100 is attached to actuator rod 104. The actuator rod 104 is mounted for axial movement in the housing 12 along mounting plate 24 and is biased by spring 106 acting against one end of the actuator rod 104. The opposite end of the actuator rod 104 carries a second cam assembly 108 while a third cam assembly 110 is fixed intermediate the ends of the actuation rod 104. An actuator pin 112 is fixed to the actuator rod 104 and extends normal thereto through mounting plate 24 to engage in the guide slot 84 of the actuator cam 78.

The wire stripper and cutter means 20 is mounted on shafts 114, 116 fixed in the mounting plate 24 to extend normal to the plane thereof and biased to the closed position by spring means. All the lateral movement of the wire stripper and cutter means 20 away from (stripping) and back towards (resetting) the wire holder and insulation cutting means 18 is along these shafts 114, 116. This movement is accomplished by roller 118 engaging the third cam assembly 110, as best can be seen by comparing FIGS. 3 and 4.

Figure 3:
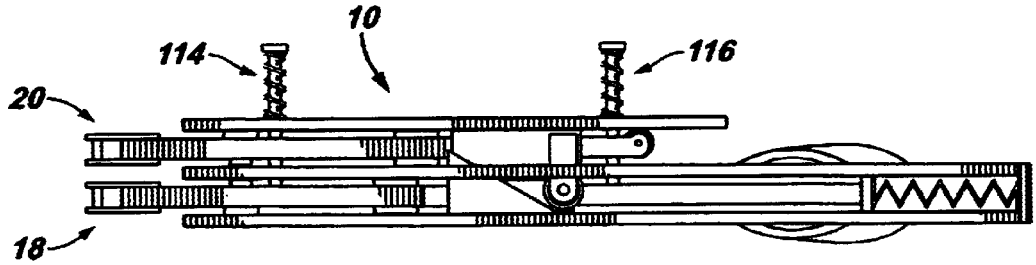
FIG. 3 is a section through the present invention taken along line 3—3 of FIG. 1, the connector feed and application assembly having been omitted for the sake of clarity, in an unactuated condition.
Figure 4:
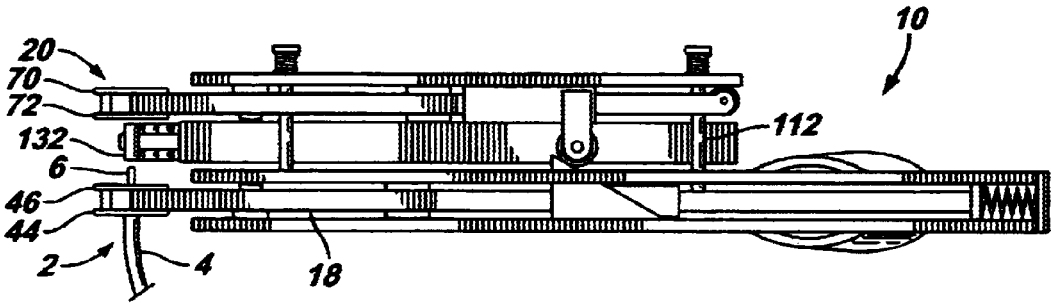
FIG. 4 is a section similar to FIG. 3 but with the tool in an actuated condition showing the connector feed and actuation assembly.

The connector feed and application means 22 has a magazine 120 containing a spring 122 therein. The connector feed and application means 22 is mounted below and between the wire holder and insulation cutter means 18 and the wire cutter and stripper means 20 and is operational only when these two means are in their fully actuated positions, as shown in FIG. 3. One end of the magazine 120 is pivotally attached to the housing 12 by pivot pin 124 and spring means 126 biases the magazine 120 so that cam follower 130 rides against a cam surface of the third cam assembly 100. Thus, when the wire holder and insulation cutter means 18 and wire cutter and stripper means 20 are spread apart, the free end of the magazine 120 rises to a point where a connector 132 carried thereby is aligned with the stripped conductor. Return movement of the wire cutter and stripper means 20 drives the connector 132 onto the bared conductor 6.

The connectors 132 has been shown only diagrammatically since the connectors themselves do not form a part of the invention. In this instance the connector 132 is a simple insulated sleeve containing therein conventional electrical wire retaining means (not shown). The free end of the stripped conductor is received in one end of the connector sleeve and is secured thereto by known retaining means (not shown). The wire and connector are then removed from the present tool and the connector inserted into a known connector housing (not shown) having retaining means, bussing means, and known contact means whereby the terminated wire is enabled for bussed connection to wires of one or more circuits. It would be within the scope of the present invention to include crimping of the connector as well as the use of connectors involving insulation piercing technology.

It is within the scope of the present invention to provide a shroud (not shown) of electrical insulating material covering the exposed portions of the wire holder and insulation cutter means and the wire stripper and cutter means making it virtually impossible for anyone using the subject tool to receive an electrical shock from the live electrical wire. This additional housing could also be configured so that virtually all movement of the tool takes place within the electrically insulating housing thereby preventing any accidental contact between the tool and any live electrical wire which contact could cause harm to the electrician.

The subject tool 10 is used by placing the open wire holder and insulation cutting means 18 and wire cutter and stripping means 20 around a live electrical wire. At this time the connector feed and application means 22 is in its lowered and out-of-the-way position. The trigger 92 of the actuation means 16 is squeezed bringing the wire gripping portions 38, 44, 64, 70 of the wire holder and insulation cutting means 18 and the wire cutting and stripping means 20, respectively, sequentially into gripping engagement with the live electrical wire 2 to be cut. Continued squeezing of the trigger causes the cutter blades 46, 72 to cut the insulation 4 and the live electrical wire 2, respectively. Further continued squeezing of the trigger 92 causes the wire cutting and stripping means 20 to be cammed laterally away from wire holder and insulation cutting means 18 causing the short cut section of insulation 4 to be removed from the conductor 6 of the live electrical wire 2. When the wire holder and insulation cutting means 18 and the wire cutting and stripping means 20 are fully separated, then the connector applicator 22 is biased to rise to a position in which it aligns the free end of the magazine 120 with the exposed conductor 6. The spring loaded magazine 120 feeds a connector 132, in this instance a simple insulated barrel or sleeve connector, between the wire holder and insulation cutter means 18 and the wire cutter and stripper means 20 and into alignment with the conductor 6. Release of the trigger 92 causes the wire holder and insulation cutting means 18 and the wire cutting and stripping means 20 to come back together driving the connector 132 onto the conductor 6, releasing the both the cut ends of the electrical wire 2 and the segment of cut insulation 4 and lowering the connector magazine 120 to its storage position.

A representative connector has been shown only diagrammatically since the connectors themselves do not form a part of the invention. In this instance the connector is a simple insulated barrel or sleeve containing conventional wire retaining means (not shown), such as a trapping finger. The thus terminated live wire and connector are then removed from the present tool and can be safely handled. The connector can be inserted into a known connector block (not shown) having retaining means, bussing means, and known contact means whereby the terminated live electrical wire is enabled for bussed connection to wires of one or more circuits.

It is within the scope of the present invention to provide a shroud (not shown) of electrical insulating material covering the exposed portions of the wire holder and insulation cutter means and the wire stripper and cutter means making it virtually impossible for anyone using the subject tool to receive an electrical shock from the wire. This additional housing could also be configured so that virtually all movement of the tool takes place within the electrically insulating housing thereby preventing any accidental contact between the tool and any live electrical wire which contact could cause harm to the electrician.

The present may be subject to many modifications and changes without departing from the spirit of essential characteristics of the present invention. Therefor the present specification should be considered in all respects as illustrative and not restrictive of the scope of the invention as defined by the appended claims.

I claim:

1. A tool for safely applying a connector to a live electrical wire, comprising:

housing means containing actuating means, wire cutting and preparation means, and connector application means;

said wire cutting and preparation means having two sections, a wire holding and insulation cutting section and a wire cutting and stripping section, respectively, each section having a wire gripping portion, an anvil and an opposing cutter blade, the wire holding and insulation cutting section cutting only the insulation of the live electrical wire and the wire cutting and stripping section completely cutting the live electrical wire;

said actuating means causing said sections to effect their respective cutting actions and then move laterally apart to an open position to thereby remove the cut section of insulation from the live electrical wire;

said connector application means feeding a connector onto the stripped conductor of said live electrical wire.

2. The tool according to claim 1 wherein said connector application means comprises:

magazine means mounted on said tool below and between said sections of said wire cutting and preparation means and being accessible to said cut live electrical wire only when the two sections of said wire cutting and preparation means are in said open position and allow access of the connector applicator means to the exposed wire.

3. The tool according to claim 2 wherein said connector application means is a spring loaded magazine pivotally mounted on said tool.

4. The tool according to claim 1 wherein said actuation means has a plurality of camming means for sequentially closing said wire gripping portions, said insulation cutter blade, said wire cutting blade, separating said sections, and moving said connector application means into position to feed a connector onto said prepared live electrical wire.

5. A tool for safely cutting a live electrical wire and applying a connector thereto, said tool comprising:

housing means enclosing wire preparation means having two adjacent, normally slightly spaced apart sections, each section having a wire gripping portion, an anvil and an opposing cutter blade, one of said cutter blades being adapted to cut only the insulation of a live electrical wire and the other cutter blade being adapted to cleanly cut said live electrical wire and connector application means for feeding a connector onto the stripped conductor of said live electrical wire, actuation means adapted to sequentially actuate said wire preparation means whereby the live electrical wire is gripped, the insulation and the live electrical wire cut, the sections moved laterally apart whereby the cut insulation is removed from the live electrical wire exposing the conductor thereof, and said connector application means feeds a connector onto the stripped conductor of said live electrical wire.

6. A tool according to claim 5 wherein said connector application means comprises:

a connector magazine mounted in said tool below and between said sections of said wire preparation means, spring means biasing said magazine towards an operative position when the two sections to spread apart, and spring means biasing connectors in said magazine to feed therefrom;

whereby said connector application means feeds a connector from said connector magazine into alignment with the exposed end of the electrical conductor, whereby releasing of the actuating means drives the connector onto the exposed portion of the electrical conductor thereby enclosing it and rendering it safe.

7. The tool according to claim 5 wherein said connector application means comprises:

magazine means containing therein a plurality of insulated barrel electrical connectors having internal wire locking means.

8. The tool according to claim 5 wherein said actuation means cams said connector application means into a feed position aligning a connector with said electrical wire.

9. The tool according to claim 5 wherein said actuation means has a plurality of camming means for sequentially closing said wire gripping portions, said insulation cutter blade, said wire cutting blade, separating said sections, and moving said connector application means into position to feed a connector onto said prepared live electrical wire.

10. A tool for safely working on a live electrical wire, comprising:

housing means of electrically insulative material with a pistol grip and containing actuating means on a first end and wire severing and connector application means at the opposite end of said housing:

said wire severing means having two sections, each with wire gripping means, an anvil and an opposing cutter, forming a wire holding and insulation cutting first section and a wire cutting and stripping second section, the first section cutting only the insulation of the live electrical wire and the second section completely cutting the live electrical wire at a position slightly spaced from the first section;

said actuating means causing said sections to move laterally apart, after cutting the live electrical wire and insulation, to remove the cut section of insulation from the live electrical wire and allow access of the connector applicator to the exposed conductor.

11. The tool according to claim 10 further comprising:

connector application means having magazine means mounted on said tool below and between said sections of said wire cutting and preparation means and being accessible to said cut live electrical wire only when the two section of said wire cutting and preparation means are in said open position and allow access of the connector applicator means to the exposed wire.

12. The tool according to claim 11 wherein said connector application means is a spring loaded magazine pivotally mounted on said tool.

13. The tool according to claim 10 wherein said actuation means has a plurality of camming means for sequentially closing said wire gripping portions, said insulation cutter blade, said wire cutting blade and separating said section, and moving said connector application means into position to feed a connector onto said prepared live electrical wire.

* * * * *